US007920069B2

(12) United States Patent
Shain et al.

(10) Patent No.: US 7,920,069 B2
(45) Date of Patent: Apr. 5, 2011

(54) AUDIBLE, PIEZOELECTRIC SIGNAL WITH INTEGRAL VISUAL SIGNAL

(75) Inventors: Thomas Shain, Westerville, OH (US); Heather Gregg, Delaware, OH (US)

(73) Assignee: Floyd Bell Inc., Columbus, OH (US)

( * ) Notice: Subject to any disclaimer, the term of this patent is extended or adjusted under 35 U.S.C. 154(b) by 267 days.

(21) Appl. No.: 12/274,612

(22) Filed: Nov. 20, 2008

(65) Prior Publication Data

US 2010/0123595 A1 May 20, 2010

(51) Int. Cl.
*G08B 5/00* (2006.01)

(52) U.S. Cl. ..... 340/815.4; 340/815.45; 340/384.1; 340/384.6; 340/388.1

(58) Field of Classification Search ..... 340/815.4, 340/815.45, 384.1, 384.6, 384.7, 388.1, 391.1, 340/392.4; 381/300, 345, 386, 388; 181/157, 181/163

See application file for complete search history.

(56) References Cited

U.S. PATENT DOCUMENTS

| | | | | |
|---|---|---|---|---|
| 2,983,903 | A | 5/1961 | Philipps | |
| 3,331,970 | A * | 7/1967 | Martin et al. | 310/324 |
| 3,421,109 | A | 1/1969 | Wiggins et al. | |
| 4,019,607 | A | 4/1977 | Mandel et al. | |
| 4,904,982 | A | 2/1990 | Lieb et al. | |
| 5,706,358 | A * | 1/1998 | Ashworth | 381/152 |
| 6,130,618 | A | 10/2000 | Burnett et al. | |
| 6,414,604 | B1 | 7/2002 | Burnett et al. | |
| 6,549,121 | B2 | 4/2003 | Povey et al. | |

* cited by examiner

*Primary Examiner* — Hung T. Nguyen

(74) *Attorney, Agent, or Firm* — Frank H. Foster; Kremblas & Foster

(57) ABSTRACT

A combined and integrated audible and visual signal. A signal case is constructed of a light transmissive material and includes an exposed front end cover with one or more sound transmitting apertures and a tubular wall extending transversely from the exposed end cover for extending through a hole in a mounting panel. A transducer is mounted within the tubular wall and includes a diaphragm that is spaced from the exposed cover. Light sources are mounted to face the diaphragm. The tubular wall in the region between the cover and a plane transverse to the tubular wall through the diaphragm is, in the axial direction, smoothly continuous with no angled bends.

17 Claims, 4 Drawing Sheets

Fig. 4
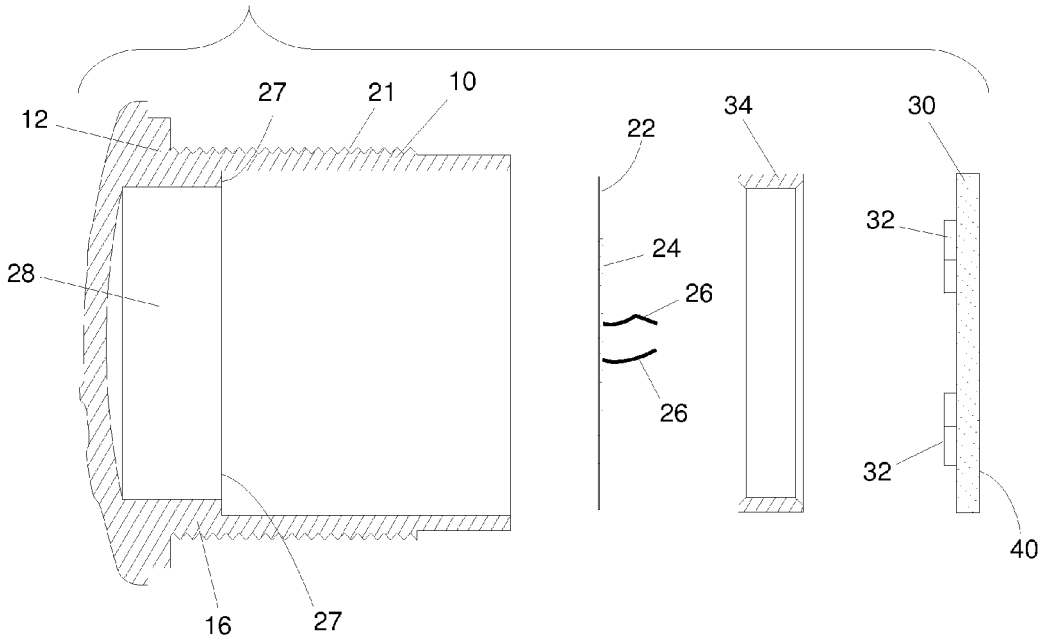
Fig. 5
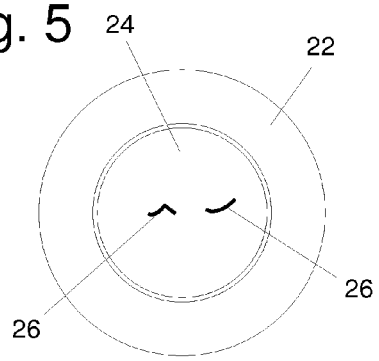
Fig. 7
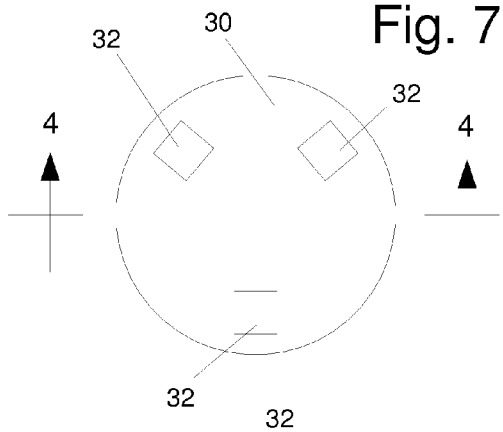
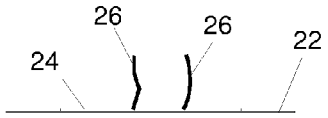
Fig. 6
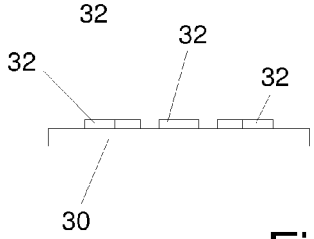
Fig. 8

AUDIBLE, PIEZOELECTRIC SIGNAL WITH INTEGRAL VISUAL SIGNAL

BACKGROUND OF THE INVENTION

1. Field of the Invention

This invention relates generally to signals and alarms and more specifically to the combination within a single module and in a compatible manner of both a piezoelectric audible signal and a light emitting visual signal.

2. Description of the Related Art

The prior art has long known a diverse variety of signals that are commonly used to signal alarm conditions and other events. These include audible signals as well as visual signals that commonly emit light sometimes according to a timed sequence pattern of illumination.

One of the best performing and most cost effective audible signals is the piezoelectric alarm that has a diaphragm driven by an electrically excited piezoelectric crystal. Commonly, its components are all housed within a case that includes a tubular wall and an exposed cover at one end. Typically, the diaphragm is mounted within the tubular wall and, when the signal is operably installed, the tubular wall extends through a hole in a panel, such as a control panel. However, the "panel" may also be a mounting bracket or other support structure. The exposed cover ordinarily seats against the front face of the panel in a position where it is exposed to the view of an operator. A sound enhancing cavity is formed within the tubular case and extends from the diaphragm to the exposed cover. The cover has one or more apertures for emitting from the cavity the sound generated by the vibrating diaphragm. The cavity is ordinarily a Helmholtz cavity which is a resonant cavity with one or more apertures for the escape of sound waves from the cavity. The cavity is dimensioned so that it is resonant in order to impedance match the diaphragm to a volume of air in the cavity so that the maximum audio power is coupled from the diaphragm to the air within the cavity. That ultimately provides the maximum intensity for the sound being emitted out of the case through the apertures.

The prior art has also shown an extensive variety of visual signals for indicating an alarm or other condition by illuminating a light source in a steady, flashing or other pattern. These visual signals are also commonly mounted to a panel and contain a light source that directly illuminates a transparent or translucent cover from which the light is transmitted to an observer.

In addition to the many separately used audible and visual signals, it is not uncommon to use both an audible signal and a separate visual signal to simultaneously signal an event, such as an alarm condition. This redundancy directs the signal to both the human sense of sight and the sense of hearing in order to increase the probability that the signal will come to the attention of a human operator or observer. An example is shown in U.S. Pat. No. 4,019,607.

The prior art has also shown signals which incorporate both an audible and a visual signal within the same signal unit. For many types of audible and visual signals, combining them in the same signal unit or case presents no major problems. However, significant difficulties arise when attempting to combine an illuminated visual signal with an audible piezoelectric signal in a manner that maintains high sound quality and intensity, durability and low cost for which piezoelectric signals are known. A major difficulty arises because the diaphragm is an opaque metal disk that prevents light sources from transmitting light through the diaphragm. Furthermore, there are at least the following four conditions that need to simultaneously coexist in a combined illuminated visual signal and an audible piezoelectric signal if the performance and cost expectations of customers, based upon their experience with previously marketed but separate audible and visual signals, is to be met.

(1) The first required condition is that the piezoelectric signal must have a sound enhancing cavity, most desirably a Helmholtz cavity, within its tubular wall between the diaphragm and the front cover with its sound emitting apertures.

(2) The second required condition is that there should be no object in the cavity because an object in the cavity would interfere with the resonance or otherwise deteriorate the intensity and/or the audio characteristics of the sound emitted from the cavity through the apertures in the cover. Consequently, the light sources themselves can not be mounted in the cavity where they could very effectively transmit light directly to the exposed cover but would interfere with the sound and cavity resonance. Furthermore, even the presence of wires extending through the cavity and through a hole in the diaphragm, as taught in U.S. Pat. Nos. 6,130,618 and 6,414,604, have a deteriorating effect upon the sound. The cavity has interior surfaces which reflect the wave. When a wave at the resonant frequency of the cavity is generated by the vibration of the diaphragm, the wave bounces back and forth within the cavity, with low loss. If the cavity were closed, a pure standing wave would be generated in the cavity. As more wave energy enters the cavity, it combines with and reinforces the standing wave, increasing its intensity. A Helmholtz cavity is a container with an aperture. The aperture allows sound waves to be emitted from the cavity but is smaller than the cavity so that some standing wave reinforcement is accomplished to improve the audible signal strength. In a prior art system that places structures in the cavity for the purpose of providing a visual signal, these structures cause additional wave reflections within the cavity resulting in deflection and some cancellation of the reflected waves in the cavity and they can also absorb some acoustic energy. Consequently, these internal structures deteriorate the resonant properties of the cavity and therefore reduce the strength and clarity of the output audible signal emitted from the cavity orifice.

(3) The third required condition is that, in order to have an effective cavity, there must be a significant spacing between the diaphragm and the exposed cover. If the signal has such a cavity that is devoid of any physical object and the exposed cover seats in the customary manner against the front surface of the panel to which the signal is mounted, then the diaphragm must be spaced behind the plane of the panel in order that the cavity have sufficient volume and wall spacing. With the diaphragm spaced behind the plane of the panel, the light source can not be placed radially inwardly from the periphery of the exposed cover or the light source would be within the cavity. Consequently, the solution in U.S. Pat. No. 4,904,982, which places the diaphragm in front of the plane of the panel and the light sources immediately behind the diaphragm, becomes impractical when there is a cavity. Of course it would also be possible to position the diaphragm far enough in front of the plane of the panel in order to have a cavity and place the light source immediately behind the diaphragm but within the exposed cover. But the result of doing so would be that the tubular wall and/or the exposed cover would protrude a distance out from the panel that would make the signal intrusive, more likely to be struck and broken by some other object, aesthetically unacceptable to customers and possibly dangerous.

(4) Mounted within the tubular wall of the case of an optimally designed signal are both the diaphragm and a printed circuit board that contains all the electrical circuitry for the signal. Not only must the diaphragm of a practical signal be spaced back from the front cover beyond the plane of the panel with nothing in the cavity, but also the circuit board must be on the opposite side of the diaphragm from the exposed panel. The fourth condition, that is highly desirable for maintaining product quality and low cost, is that the diaphragm and the printed circuit board need to extend radially outwardly to reach the inner surface of the tubular wall of the case so that both can be rigidly and inexpensively mechanically mounted to the case, such as with an adhesive or mechanical clamping. If the circular diaphragm did not extend to the tubular wall, but instead left a space for light to pass beside the diaphragm, additional small mounting parts would be needed, making the signal more expensive to fabricate and the diaphragm and the mounting parts would be more likely to come loose from the tubular wall as a result of vibration or sudden acceleration.

It is therefore an object of the present invention to integrate a visual signal, that emits light, into the same module that houses a piezoelectric audible signal without diminishing the space available for a cavity and without having structures within the cavity that can diminish its resonant characteristics and to do so with mechanically simple parts that can be easily and inexpensively assembled in a durable configuration.

BRIEF SUMMARY OF THE INVENTION

The invention is an audible and visual signal that has a case constructed of a light transmissive material. The case includes an exposed cover that is visible when the signal is mounted in an operable position to a mounting panel and has one or more sound transmitting apertures for transmitting of sound out of the case. The case also has a tubular wall extending transversely from the exposed end cover for extending through a hole in the mounting panel. The case surrounds and contains the signal operating components. A piezoelectric transducer is mounted within the tubular wall and includes a diaphragm that is spaced from the exposed cover a distance to form an audio enhancing cavity between the diaphragm and the cover. A circuit board or boards are also mounted within the tubular wall and spaced from the diaphragm on the opposite side of the diaphragm from the cover. A light source is mounted to a surface of the circuit board facing the diaphragm. Desirably, the tubular wall in the region between the cover and a plane transverse to the tubular wall through the diaphragm is, in the axial direction, smoothly continuous with no angled bends. More preferably, the smoothly continuous wall that has no angled bends extends from the cover all the way to the circuit board. Most preferably, the smoothly continuous portion of the tubular wall that has no angled bends extend in the axial direction along a straight line.

BRIEF DESCRIPTION OF THE SEVERAL VIEWS OF THE DRAWINGS

FIG. 4 is an exploded view in section of the embodiment of FIG. 1 taken substantially along the line 4-4 of FIG. 2.

FIG. 5 a front view of the diaphragm component of the embodiment illustrated in FIGS. 1 and 4.

FIG. 6 is a side, edge view of the diaphragm of FIG. 5.

FIG. 7 is a front view of the circuit board illustrated in FIGS. 1 and 4.

FIG. 8 is a side, edge view of the circuit board of FIG. 7.

Figure 1:
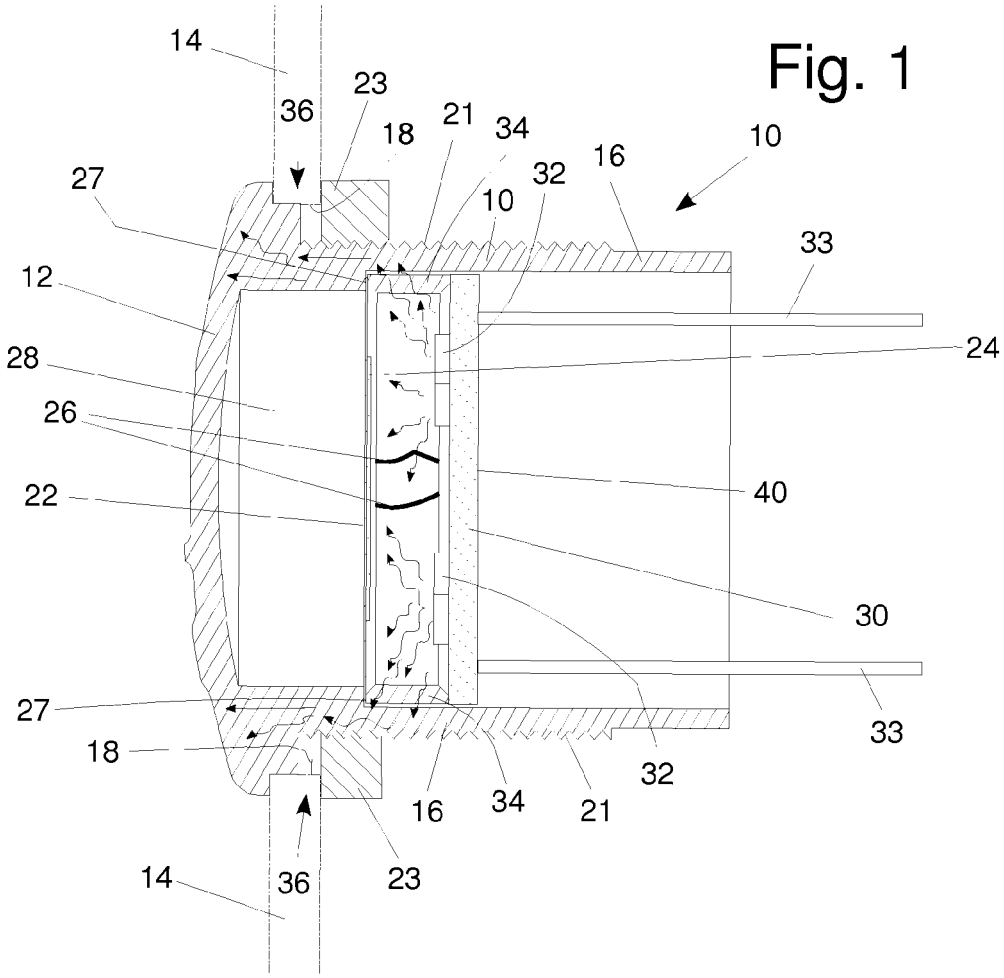
FIG. 1 is a view in axial section of the assembled preferred embodiment of the invention taken substantially along the line 4-4 of FIG. 2.
Figure 2:
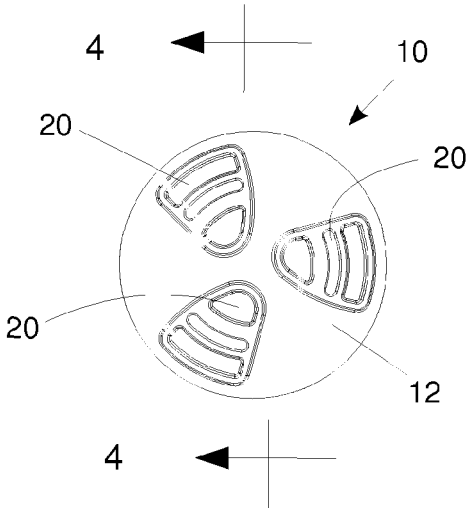
FIG. 2 is a front view of the embodiment of FIG. 1.
Figure 3:
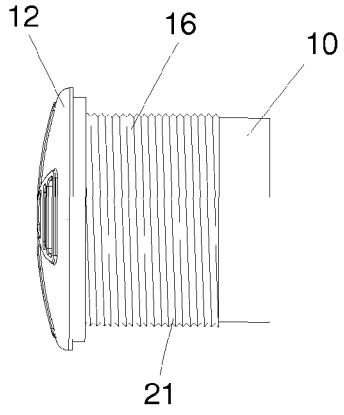
FIG. 3 is a side view of the embodiment of FIG. 1.
Figure 9:
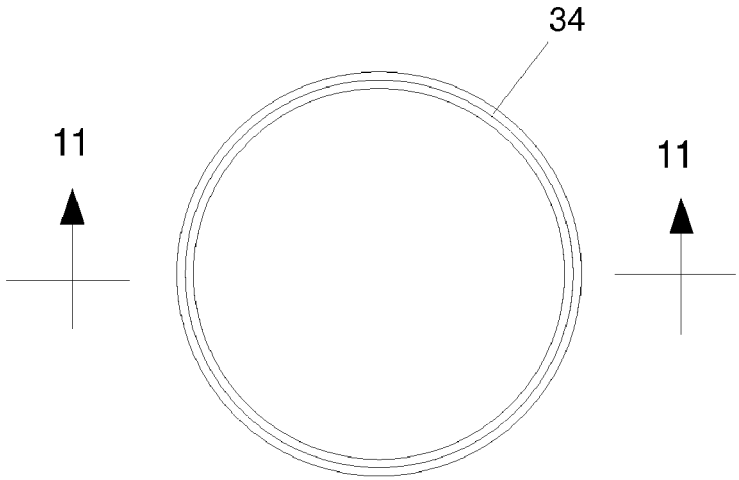
FIG. 9 is a front view of the ring component of the embodiment illustrated in FIGS. 1 and 4.
Figure 10:
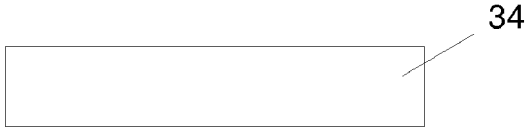
FIG. 10 is a side, edge view of the ring of FIG. 9.
Figure 11:
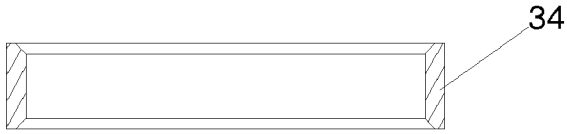
FIG. 11 is a view in axial section of the ring of FIG. 9 taken substantially along the line 11 of FIG. 9.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

FIGS. 1-11 are views of a combined and integrated audible and visual signal comprising the preferred embodiment of the invention and its components. A case 10 constructed of a light transmissive material has an exposed cover 12 that is visible when the signal is mounted in an operable position to a mounting panel 14, shown in phantom. The currently preferred light transmissive material for embodiments of the invention is transparent ABS plastic but may, for example, be another material such as a polycarbonate or acrylic plastic. The case 10 also has a tubular wall 16 extending transversely from the exposed end cover 12 and preferably is molded as a unitary body with the cover 12. The tubular wall 16 surrounds and contains the signal operating components. When mounted for use, the tubular wall 16 extends through a hole 18 in the mounting panel 14. The cover 12 has at least one aperture for transmission of sound out of the case and preferably has a plurality of such apertures 20 through the exposed cover 12. The case 10 can be transparent or translucent and is clear and uncolored or can also be colored, so long as it retains its light transmissive property. Male screw threads 21 are formed on the exterior surface of the tubular wall 16 so that, after it is inserted through the hole 18 in the panel 14, a nut member 23 can be screwed onto the tubular wall 16 and tightened against the backside of the panel 14 to hold the case 10 on the panel 14. Of course it is not necessary that the tubular wall have a circular cross section. Although a tubular configuration having an oval, square or other cross section can be adapted to embodiments of the invention, they introduce additional complication and therefore are not preferred. Similarly, it is not necessary that the tubular wall have an identical cross section along its entire length. It could have a small taper and could have a frusto-conical configuration, although that is also not preferred.

A piezoelectric transducer, constructed as in the prior art and including a diaphragm 22 and the piezoelectric material 24 with electrical conductors 26, is mounted within the tubular wall 16 of the case 10. The diaphragm 22 seats against a small shoulder 27 formed on the interior surface of the tubular wall 16. In this manner, the diaphragm is held spaced from the exposed cover 12 a distance to form an audio enhancing cavity 28 between the diaphragm 22 and the cover 12. The diaphragm 22 can be fixed to the shoulder 27 by an adhesive, held by a ring as described below, or attached by still other means to the interior surface of the tubular wall 16.

Electrical conductors 26 for energizing the piezoelectric transducer are connected to a circuit board 30 that is mounted within the tubular wall 16. The circuit board 30 is spaced from the diaphragm 22 on the opposite side of the diaphragm 22 from the cover 12. At least one, preferably a plurality, and most preferably three light sources 32 are mounted to the surface of the circuit board 30 that faces the diaphragm 22. The preferred light sources are high intensity LEDs that emit white light. However, the light sources may alternatively be colored, such as red or green. By mounting the LEDs to the circuit board, fabrication costs are minimized while maximizing the strength of their mechanical connection so that they will not move, collide or fatigue loose in a vibratory environment or from mechanical shock. A pair of conductors 33 extend from the circuit board 30 out of the case 10 for connection to an external control circuit and source of power. At least an axial segment of the space around the conductors 33 and within the tubular wall 16 is filled with a potting compound to seal all the components from the exterior environment and hold them rigidly within the tubular wall 16.

A ring 34, that is also constructed of a light transmissive material, extends in its axial direction between the diaphragm 22 and the circuit board 30. The ring 34 slides within and frictionally engages the tubular wall 16 for retaining the diaphragm against the shoulder 27. The ring 34 also provides a shoulder surface against which the circuit board 30 seats for positioning the circuit board 30 in the tubular wall 16.

Importantly, the tubular wall 16, in the region between the cover 12 and a plane transverse to the tubular wall 16 through the diaphragm 22 is, in the axial direction, smoothly continuous with no angled bends. Most preferably, the tubular wall 16 in the region between the cover 12 and the plane transverse to the tubular wall 16 through the diaphragm 22 is, in the axial direction, along a straight line. The reason that such a generally straight path in the axial direction is important is that light that is emitted from the light sources 32 is able to travel along and within the tubular wall 16 encountering or being incident upon transverse walls or significant bends at which a portion of the light would be reflected or refracted away from it travel to the exposed cover 12. Such reflection or refraction would substantially reduce the intensity of light that eventually is emitted from the cover 12. For example, if the tubular wall were constructed in the configuration for the assembly shown in U.S. Pat. No. 6,130,618 and a light source were positioned on the opposite side of its diaphragm from its front face, then the light would not only encounter two 90° bends that would cause significant reflection away from its front face, but also the portion of the light that encounters the first 90° bend and is transmitted axially through the wall would then be incident upon the backside of the panel to which the assembly is mounted where it would not be visible. An angled bend exists if the light traveling through the tubular wall, approximately parallel to the longitudinal axis of the tubular wall, is incident upon a surface that is inclined to the direction of light travel at more than the acceptance angle for the tubular wall material in air.

Most preferably, the region of the tubular wall that is, in the axial direction, smoothly continuous with no angled bends, and more desirably is along a straight line, extends all the way from the cover beyond the diaphragm and at least to a plane that is transverse to the tubular wall and passes through the circuit board. With the relatively straight tubular wall configuration extending all the way back to the circuit board, all of the light that is incident on the interior surface of the tubular wall between the diaphragm and the circuit board has a relatively straight path from there to the exposed front cover 12.

As in the prior art, a panel locating segment 36 is formed adjacent the exposed cover 12 and around the exterior of the tubular wall 16 at a location at which the signal is mounted to the support panel 14. Typically, the panel locating segment 36 includes an annular shoulder that seats against the front surface of the panel 14 around the hole 18. As seen in FIG. 1, the diaphragm 22 is spaced from the exposed cover 12 beyond the panel locating segment 36 for forming the cavity 28. This places the diaphragm 22 less recessed behind the plane of the panel 14 than the light sources 32. From FIG. 1 and the above description, it is apparent that the cavity 28 is devoid of any object that deteriorates the sound intensity. It is also apparent that the diaphragm 22 and the circuit board 30 extend to the tubular wall for facilitating retention within the tubular wall 16. The circuit board 30 may additionally or alternatively be adhesively attached to the interior surface of the tubular wall 16. However, that is believed unnecessary when potting compound is filled into the volume within the tubular wall 16 and against the distal surface 40 of the circuit board 30. All the interior components may be held in place by adhesive, such as potting compound, when the ring 34 seats against the diaphragm 22 and the circuit board 30 seats against the ring 34.

In operation, the LEDs 32 emit light directed approximately throughout a hemispherical solid angle. Much of the light that is incident upon the ring 34 is transmitted radially through the ring 34 and then along the tubular wall 16 directly toward the exposed cover 12. Some of the light is refracted and/or reflected to and emitted from essentially all parts of the cover 12. However, a large proportion of the light is transmitted forwardly through the front surface of the cover 12 out toward an observer. This produces a desirable brighter, circular, halo effect surrounded by a light of larger area but less intensity.

Figure 12:
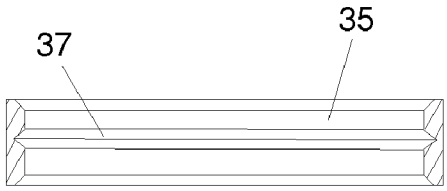
FIG. 12 is a view in axial section of an alternative ring structure.

FIG. 12 illustrates an alternative embodiment of the previously described ring 34. The ring 35 is like the ring 34 except that is has a circular groove 37 formed along the interior surface of the ring. The groove 37 has a contour to form a Fresnel lens for refracting light incident upon a wall surface of the groove 37 toward the exposed cover. The illustrated groove 37 has a V shaped cross section with the wall surface of the groove that is closest to the exposed cover at an angle determined by the prior art principles of Fresnel lenses. That angle for one wall surface of each such groove is selected so that light incident upon that wall is refracted toward the exposed front cover. Of course multiple such grooves, including those formed between multiple ridges, may be formed on the interior of the ring 34.

Figure 13:
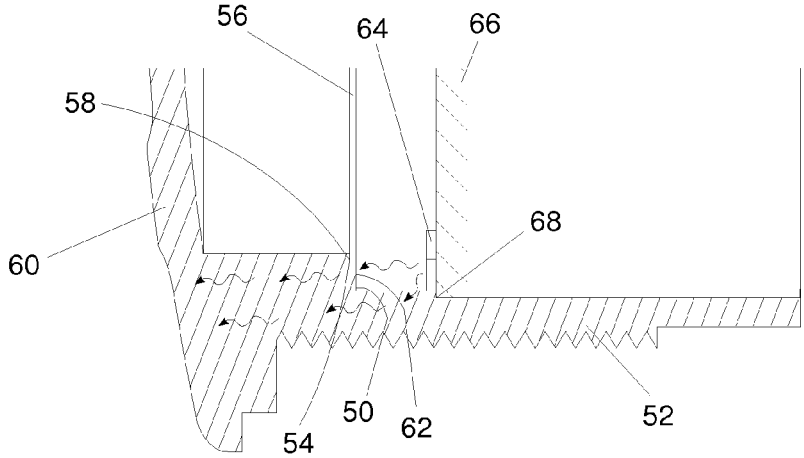
FIG. 13 is a view in section taken like the sectional view of FIG. 1 but illustrating an alternative embodiment of the invention.

FIG. 13 illustrates an alternative embodiment of the invention. A circular shoulder 50 is formed around the interior surface of the tubular wall 52. The shoulder 50 extends radially outwardly beyond the periphery 54 of the diaphragm 56. A secondary, circular shoulder 58 may also be formed between the diaphragm 56 and the exposed cover 60 for receiving the diaphragm 56. The diaphragm may be mounted in the secondary shoulder 58 and attached to the tubular wall 52 by an adhesive or held by a ring as described below in connection with the embodiment of FIG. 14. Alternatively, the secondary shoulder may be omitted and the diaphragm 56 adhesively bonded to the interior surface of the tubular wall 52. Importantly, because the shoulder 50 extends radially outwardly beyond the periphery 54 of the diaphragm 56, the major portion of the shoulder 50 forms an annular light-receiving surface 62 that is aligned along a straight line from the light-receiving surface 62 through the exposed cover 60.

The circuit board 66 is mounted within the tubular wall 52 and can be seated within a circular shoulder 68 and/or bonded to the interior surface of the tubular wall 52 with and adhesive. A plurality of light sources, such as light source 64, are mounted to the circuit board 66 opposite the light-receiving surface 62 of the shoulder 50. This physical arrangement permits light to be transmitted directly in a straight line from the light source 64, through the light-receiving surface 62, through the tubular wall 52 to the exposed cover 60. Preferably, several light sources are positioned around the edge of the circuit board 66 at angular intervals all of them opposite the light-receiving surface 62.

Figure 14:
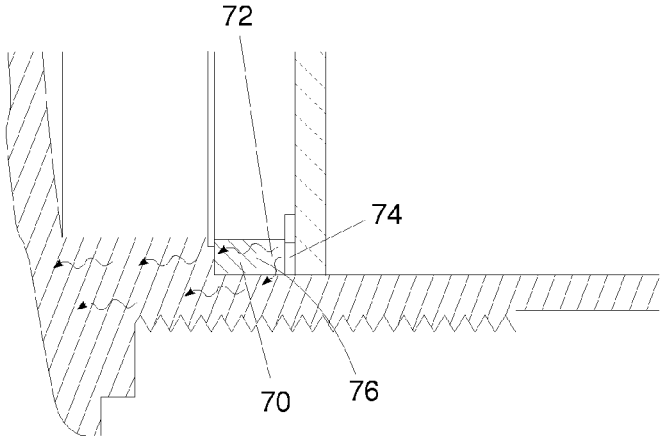
FIG. 14 is a view in section taken like the sectional view of FIG. 1 but illustrating yet another alternative embodiment of the invention.
Figure 15:
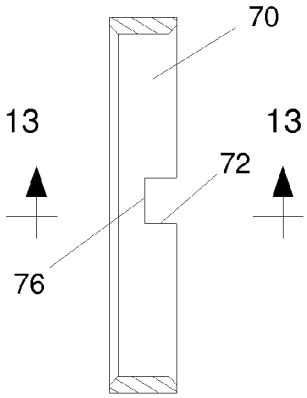
FIG. 15 is a view in axial section of the ring component of the embodiment illustrated in FIG. 14.

FIGS. 14 and 15 illustrate another alternative embodiment of the invention. This embodiment differs from the embodiment of FIG. 13 because it uses a ring 70 that can have most of the characteristics of the embodiment of FIGS. 1-11 as well as the Fresnel lens surfaces described in connection with FIG. 12. However, the ring 70 of FIGS. 14 and 15 is "castled" because it has a notch 72 formed in the ring 70 at the position of each light source 74. This embodiment allows use of a ring, which provides a strong but easily assembled support for both the diaphragm and the circuit board, but also has the relieved portion of a notch at each light source 74 so that the light sources may be positioned at the periphery of the circuit board in line with a generally straight light transmitting path to the exposed cover. The bottom surface 76 of each notch 72 may also be inclined to a radius that is perpendicular to the central axis of the tubular wall so the light from the light source 74 that is incident upon the bottom surface of the notch 72 is refracted parallel with that axis to the exposed cover.

From the drawings and the above description, it is apparent that the invention provides a piezoelectric sound signal with a full, unobstructed Helmholtz cavity that does not protrude from a panel to which it is mounted any more than conventional sound signals and also has an integral light signal without requiring any separate light guide and has no optical obstruction in the form of bends or turns in the light path along the axial direction as the light is transmitted to the front, exposed cover. The light travels essentially straight to the viewer. There are no bends that are at a sufficient angle that all or a substantial portion of the light is refracted, reflected or otherwise directed away from a path to the exposed cover.

As a further enhancement, in any of the embodiments of the invention, the surface of the diaphragm that faces the circuit board may be provided with a reflective surface. As a result, light that is incident upon that surface will be reflected back into the space between the diaphragm and the circuit board. Consequently, a greater proportion of that light will be reflected from other surfaces and "bounce around" within that space until it is directed to the exposed cover. This effect can be further enhanced by providing reflective surfaces upon the circuit board surface that faces the diaphragm and/or some components mounted to the circuit board.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An audible and visual signal comprising:

(a) a case constructed of a light transmissive material and having an exposed cover that is visible when the signal is mounted in an operable position to a mounting panel and also having a tubular wall extending transversely from the end cover for extending through a hole in the mounting panel and surrounding and containing signal operating components, the cover having at least one aperture for transmission of sound out of the case;

(b) a piezoelectric transducer including a diaphragm that is mounted within the tubular wall of the case and spaced from the exposed cover a distance to form an audio enhancing cavity between the diaphragm and the cover;

(c) a circuit board mounted within the tubular wall and spaced from the diaphragm on the opposite side of the diaphragm from the cover; and (d) a light source mounted to a surface of the circuit board facing the diaphragm.

2. The audible and visual signal in accordance with claim 1 wherein the tubular wall in the region between the cover and a plane transverse to the tubular wall through the diaphragm is in the axial direction smoothly continuous with no angled bends.

3. The audible and visual signal in accordance with claim 2 wherein the tubular wall in the region between the cover and a plane transverse to the tubular wall through the circuit board is in the axial direction smoothly continuous with no angled bends.

4. The audible and visual signal in accordance with claim 2 wherein the tubular wall in the region between the cover and a plane transverse to the tubular wall through the diaphragm is in the axial direction along a straight line.

5. The audible and visual signal in accordance with claim 1 wherein the tubular wall in the region between the cover and a plane transverse to the tubular wall through the circuit board is in the axial direction along a straight line.

6. The audible and visual signal in accordance with claim 2 wherein the cavity is devoid of any object that deteriorates the sound intensity.

7. The audible and visual signal in accordance with claim 2 wherein a panel locating segment is formed adjacent the exposed cover and around the tubular wall at a location at which the signal is mounted to a support panel and wherein the diaphragm is spaced from the exposed cover beyond the panel locating segment for forming the cavity.

8. The audible and visual signal in accordance with claim 7 wherein the diaphragm and the circuit board extend to the tubular wall for facilitating retention within the tubular wall.

9. The audible and visual signal in accordance with claim 7 wherein a ring constructed of a light transmissive material extends in its axial direction between the diaphragm and the circuit board for retaining the diaphragm and positioning the circuit board.

10. The audible and visual signal in accordance with claim 8 wherein a circular shoulder is formed on the interior of the tubular wall extending radially outwardly beyond a periphery of the diaphragm and forming a light-receiving surface that is along a straight line from the light-receiving surface through the exposed cover.

11. The audible and visual signal in accordance with claim 10 wherein a plurality of light sources and mounted to the circuit board opposite the light-receiving surface of the shoulder for permitting light to be transmitted directly through the exposed cover.

12. The audible and visual signal in accordance with claim 11 wherein a ring constructed of a light transmissive material extends in its axial direction between the diaphragm and the circuit board for retaining the diaphragm and positioning the circuit board and the ring has a plurality of notches located to receive the light sources.

13. The audible and visual signal in accordance with claim 2 wherein a ring constructed of a light transmissive material extends in its axial direction between the diaphragm and the circuit board for retaining the diaphragm and positioning the circuit board and wherein a circular groove is formed along the interior surface of the ring having a contour to form a Fresnel lens for refracting light incident upon a wall of the groove toward the exposed cover.

14. The audible and visual signal in accordance with claim 2 wherein a surface of the diaphragm facing the circuit board is provided with a reflective surface.

15. A method of illuminating an exposed cover of a piezoelectric audible signal that is mountable to a panel in order to also provide a visual signal, the audible signal having a piezoelectric transducer including a diaphragm that is spaced from the exposed cover beyond the panel to form a sound cavity and also having a circuit board spaced beyond the diaphragm, the method comprising:

(a) forming a casing of the signal of a light transmissive material;

(b) attaching at least one light source to the circuit board on a circuit board surface facing the diaphragm; and (c) providing a tubular wall surrounding the diaphragm and the circuit board that is shaped along a direction parallel to an axis through the diaphragm and circuit board with a smoothly continuous contour having no angled bends.

16. The method in accordance with claim 15 wherein the smoothly continuous contour having no angled bends is a straight line.

17. The method in accordance with claim 15 and further comprising positioning no physical object within a cavity formed between the exposed cover and the diaphragm.

* * * * *